US006793318B2

(12) United States Patent
Saksa

(10) Patent No.: US 6,793,318 B2
(45) Date of Patent: Sep. 21, 2004

(54) CAPPING SYSTEM INCLUDING A WIPER

(75) Inventor: Thomas A. Saksa, Albany, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/345,816

(22) Filed: Jan. 15, 2003

(65) Prior Publication Data

US 2004/0135842 A1 Jul. 15, 2004

(51) Int. Cl.[7] ..... B41J 2/165
(52) U.S. Cl. ..... 347/29; 347/33; 347/109
(58) Field of Search ..... 347/22–35, 109; 400/88

(56) References Cited

U.S. PATENT DOCUMENTS 5,682,186 A * 10/1997 Bohorquez et al. ..... 347/29
6,015,211 A * 1/2000 Kinoshita et al. ..... 347/109
6,474,773 B1 * 11/2002 Silverbrook et al. ..... 347/29
6,543,892 B2 * 4/2003 Kubota et al. ..... 347/109

FOREIGN PATENT DOCUMENTS

| | | |
|---|---|---|
| DE | 8205426 | 8/1986 |
| GB | 2087800 | 6/1982 |
| JP | 10-193627 | * 7/1998 |
| WO | WO 03/068513 | 8/2003 |

* cited by examiner

*Primary Examiner*—Shih-Wen Hsieh

(57) ABSTRACT

A capping system for a printhead includes a handheld printjet printing device having a printhead and a cap including a flexible wiper. The cap is structured to be manually placed on the printing device so that the wiper wipes the printhead during placement thereon.

27 Claims, 1 Drawing Sheet

CAPPING SYSTEM INCLUDING A WIPER

BACKGROUND

Inkjet printing mechanisms, such as those used in desktop printers, use printheads which may shoot drops of liquid colorant, referred to generally herein as "ink," onto a page. Each printhead has very small nozzles through which the ink drops are fired. To print an image, the printhead is propelled back and forth across the page, shooting drops of ink in a desired pattern as it moves. The particular ink ejection mechanism within the printhead may take on a variety of different forms, such as those using piezo-electric or thermal printhead technology. For instance, two earlier thermal ink ejection mechanisms are shown in U.S. Pat. Nos. 5,278,584 and 4,683,481, both assigned to the present assignee, Hewlett-Packard Company. In a thermal inkjet system, a barrier layer containing ink channels and vaporization chambers is located between a nozzle orifice plate and a substrate layer. This substrate layer typically contains linear arrays of heater elements, such as resistors, which are energized to heat ink within the vaporization chambers. Upon heating, an ink droplet is ejected from a nozzle associated with the energized resistor. By selectively energizing the resistors as the printhead is moved across the page, the ink is expelled in a pattern on the print media to form a desired image (e.g., picture, chart or text).

To clean and protect the printhead, a "service station" mechanism can be mounted within the printer chassis so the printhead can be moved over the station for maintenance. For storage, or during non-printing periods, the service station may include a wiping system for wiping the printhead and/or a capping system which seals the printhead nozzles from contaminants and drying.

New applications for inkjet technologies may involve handheld, portable printing devices that print on non-traditional print media using fluids including ink and/or other fluids. Because these devices may "print" using fluids other than ink, the devices shall be referred to herein as printjet devices. These applications may include cosmetics applicators, topical medical delivery devices, artist pens, and other such portable inkjet applicators. The mechanical and electrical complexity of traditional servo-driven service stations make them poorly suited for use in these new inexpensive, portable printjet application devices.

SUMMARY OF THE INVENTION

A capping system for a printhead comprises a handheld printjet printing device including a printhead and a cap including a flexible wiper. The cap is structured to be manually placed on the printing device so that the wiper wipes the printhead during placement thereon.

DETAILED DESCRIPTION OF THE DRAWINGS

Figure 1:
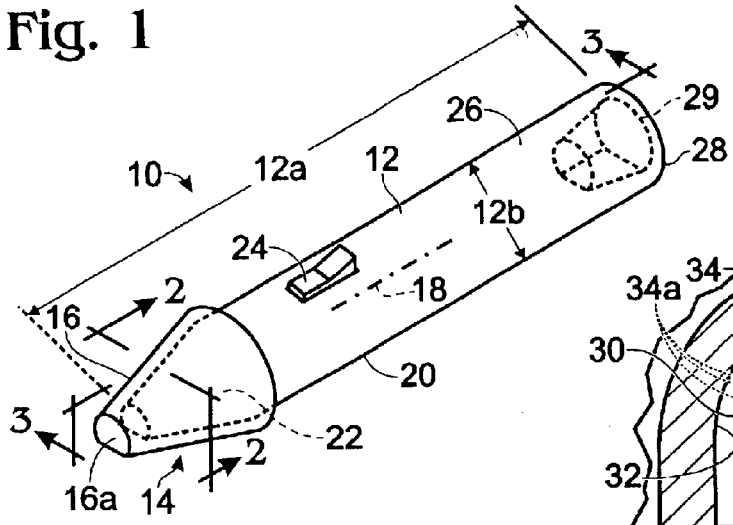
FIG. 1 is a perspective view of one form of a printjet printing mechanism, here shown as a portable, handheld printjet printer, having one form of the capping system positioned thereon according to an embodiment of the present invention.

FIG. 1 illustrates one embodiment of the printjet printing mechanism, here shown as a handheld, portable printing mechanism 10, also referred to as a handheld pen or applicator, which may be used for the application of a cosmetic, a medicine, an ink, or another such fluid. (Those skilled in the art will appreciate that the "fluid" applied by printing mechanism 10 may be stored prior to use within the printhing mechanism in another form such as in the form of a solid block or a powered substance). Printing mechanism 10 includes a printer 12 and a capping system 14, such as a cap 16. Cap 16 generally is manually placeable on, and removable from, printer 12 along a printer axis 18.

In the embodiment shown, printer 12 comprises an elongate grip portion 20 having a generally round or cylindrical cross sectional shape, as measured perpendicular to printer axis 18, so as to allow comfortable gripping of the handheld pen by a user. Grip portion 20 may comprise a soft foam cushion (not shown) for the comfort of the user, a transparent plastic shell so that the interior contents of the grip portion can be viewed by a user, a decorative outer coating, or another such asthetically pleasing design. Printer 12, in the embodiment shown, comprises a handheld, pen shaped device wherein the printer has a length 12*a* of approximately eight inches, and typically less than twelve inches, and a width, such as a diameter 12*b*, of approximately one half inch, and generally less than one inch. In the embodiment shown, cap 16 generally comprises a generally cylindrical, tapered hollow interior adapted to mate with the tapered exterior shape of an end region of printer 12 much like a traditional writing instrument. The shape of the embodiment shown merely provides a familiar shaped pen for users but those skilled in the art will understand that any size and shape of the handheld applicator may be utilized.

Cap 16 and an end region 22 of printer 12 may each comprise a "D" shaped cross sectional shape such that cap 16 may only be placed on end region 22 of printer 12 in a single, predetermined orientation. Of course, other cross sectional shapes of printer 12 and cap 16 may be utilized, including other shapes that ensure that cap 16 may only be placed on printer 12 in a single, predetermined orientation. For example, the printer and the cap may each comprise mating cross sectional shapes such as a triangle, a "U" shape, or an irregular rhomboid, that ensure placement of the cap on the printer in a single, predetermined orientation. In other embodiments, printer 12 and cap 16 may include alignment devices to ensure placement in a single, predetermined orientation. For example, printer 12 may include a notch on an outer surface of end region 22 wherein cap 16 includes a projection on an inner surface thereof, the projection adapted to mate with the notch to ensure proper alignment. Placement of cap 16 on printer 12 in such a single, predetermined orientation ensures that a wiper positioned within cap 16 will be correctly positioned to wipe a printhead positioned on the printer each time the cap is placed on or removed from the printer, as will be discussed in more detail below. However, placement of cap 16 on printer 12 in a single predetermined orientation is not a requirement of the present invention. In other words, a wiper positioned within cap 16 will generally wipe the entire surface of a printhead positioned on printer 12 regardless of the orientation of the cap with respect to the printer. Accordingly, cap 16 and printer 12 may each be manufactured with a symetrical shape, such as a circular cross sectional shape, similar to a typical writing pen, wherein cap 16 may be placed on printer 12 in any rotational configuration.

Still referring to FIG. 1, grip portion 20 of applicator 12 may include a switch 24 positioned on an exterior surface 26 of the applicator. In the embodiment shown, switch 24 is movable along axis 18 between "ON" and "OFF" positions, wherein in the ON position, circuitry positioned within the applicator is powered so as to eject fluid from the printhead, and wherein in the OFF position, the circuitry is not powered, as will be described in more detail below. An end region 28 of grip portion 20, positioned opposite end region 22, may include a recessed region 29 sized for frictionally receiving a tip end 16*a* of cap 16 when the cap is removed from end region 22 of the applicator, such as during periods of printing.

Figure 2:
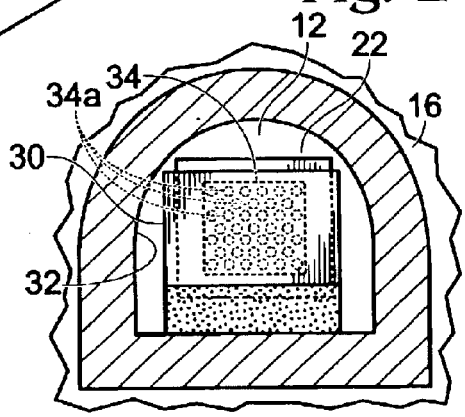
FIG. 2 is a cross-sectional view, taken along line 2—2 of FIG. 1, showing the cross sectional shape of the printer and the capping system according to an embodiment of the present invention.

FIG. 2 is a cross-sectional view, taken along line 2—2 of FIG. 1, showing the cross sectional shape of region 22 of the printer and the capping system. In the embodiment shown, cap 16 and end region 22 of applicator 12 both have a "D" shaped cross sectional shape such that cap 16 may be placed on end region 22 in only a single, predetermined orientation. This predetermined orientation ensures that a wiper 30 secured to an interior surface 32 of cap 16 will wipe across a printhead 34 positioned on applicator 12 in end region 22. However, any shape of printer 12 and cap 16 may be utilized in the present invention, wherein wiper 30 is sized so that the wiper wipes across each of the nozzle apertures 34*a* (the apertures 34*a* are shown in this view through wiper 30 for ease of illustration but normally would be hidden from view beneath wiper 30) on printhead 34. Wiping of printhead 34 removes excess fluid residue from the printhead surface thereby decreasing the likelihood that such excess fluid residue will block or otherwise obstruct nozzle apertures 34*a*.

Figure 3:
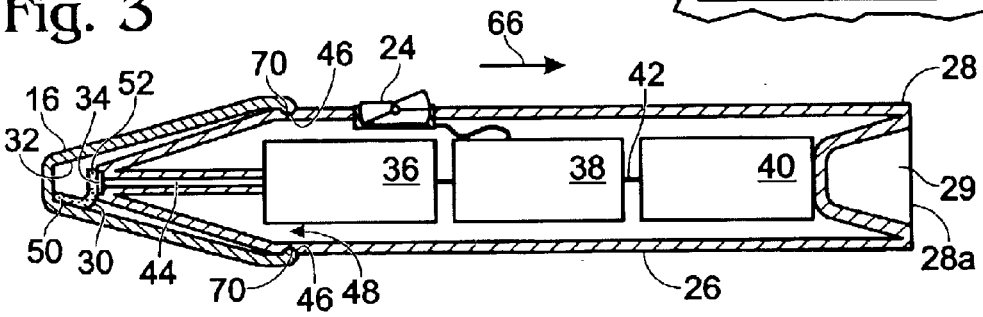
FIG. 3 is a side cross-sectional view, taken along line 3—3 of FIG. 1, of one form of the printing mechanism including the capping system shown in place thereon according to an embodiment of the present invention.

FIG. 3 is a side cross-sectional view of one form of the printing mechanism of FIG. 1, including the capping system shown in place thereon. Printer 12 is shown including printhead 34 in end region 22, a fluid reservoir 36, drive electronics 38, also referred to as a controller, and a power source 40. Printhead 34, reservoir 36, controller 38, power source 40, and switch 24 are each operatively connected to one another, such as by wiring 42 or other connection means. Printhead 34 typically is operatively connected to reservoir 36 by a passageway 44. Fluid reservoir 36 typically includes a fluid therein, such as a cosmetic, a medicine, an ink, or another fluid for use in a particular application. As stated above, reservoir 36 may store the applied "fluid" in another form, such as in solid or powered form, wherein the applied "fluid" is converted to liquid form prior to, during or just after passage through printhead 34.

Drive electronics 38 may comprise any type circuitry or controller that functions to operate printhead 34 to eject fluid therefrom. Power source 40 may comprise a standard battery, a rechargable battery, a solar power cell, or any other type power device that functions to power the operation of applicator 12. Power source 40 typically comprises a stand-alone power source, meaning that the power source is self-contained within printer 12, i.e., does not need connection to a power source positioned outside housing 26 of the applicator. End region 28 of printer 12 may comprise a removable endwall 28*a*, such as a twist-off end piece, such that a spent power source may be replaced during the working life of the printer or such that reservoir 36 may be refilled or replaced.

Still referring to FIG. 3, cap 16 is shown including a projection 46 positioned around an opening 48 of the cap, wherein projection 46 is sized to frictionally engage a recess 70 on exterior surface 26 of printer 12 to frictionally secure the cap thereto. Cap 16 further includes interior surface 32 having wiper 30 secured thereto. Wiper 30 may be manufactured of a flexible, resilent material, having a memory, such as nitrile rubber or the like. However, any material that flexes upon contact with printhead 34 will function to wipe the printhead 34, as is desired. Wiper 30 may include a first region 50 secured to interior surface 32, and a second region 52, positioned at the opposite end of the wiper from first region 50. Second region 52 typically is not secured to interior surface 32 such that the second region is free to flex upon contact with printhead 34. Wiper 30 may be manufactured having a durometer, i.e., a measure of flexibility, which allows second region 52 of the wiper to be positioned flush against printhead 34 when the cap is secured to the printer, as shown, thereby capping or sealing the nozzles 34*a* of the printhead 34 during periods of non-use. Sealing of the nozzles during periods of non-use prevents ink residue from drying inside of or on the nozzles, and prevents contaminants from entering the nozzles, thereby reducing the likelihood that the nozzles will become blocked or otherwise obscured. In other words, wiper 30 functions to wipe printhead 34 during placement of cap 16 on, and removal of the cap from, the printer and also functions to cap, i.e., seal, the nozzles 34*a* of printhead 34 while cap 16 is secured to end region 22 of printer 12. Moreover, the multi-functioning wiper, i.e., the wiping and capping functions of wiper 30, are accomplished manually by the user, without the requirement of a motor or the complicated drive circuitry of service stations used in desk top type printing devices.

Figure 4:
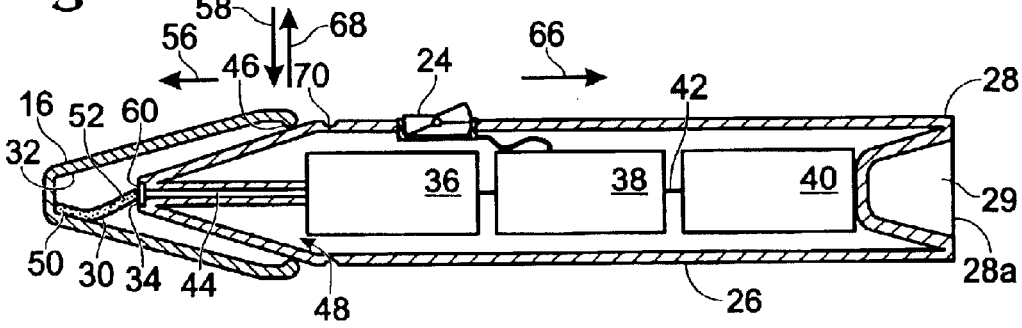
FIG. 4 is a side cross-sectional view of one form of the printing mechanism of FIG. 1, including the capping system shown partially removed from the handheld inkjet printer according to an embodiment of the present invention.

FIG. 4 is a side cross-sectional view of the printing mechanism, showing cap 16 partially removed from the handheld inkjet printer 12. In particular, cap 16 is shown moved in direction 56 along axis 18 so that projection 46 of cap 16 is no longer engaged with exterior surface 26 of printer 12. In this postion, second end region 52 of wiper 30 is shown in the process of being wiped across printhead 34 in a direction 58 so that second end region 52 of the wiper is wiping excess ink and/or debris from printhead 34. Due to the flexible, resilient nature of wiper 30, as cap 16 is moved in direction 56, second end region 52 of wiper 30 is wiped in direction 58 across the nozzle containing surface 60 of printhead 34. Continued movement of cap 16 in direction 56 will result in wiper 30 wiping the entire nozzle containing surface 60 of the printhead 34 in direction 58, at which point wiper 30 will become disengaged from printhead 34.

Figure 5:
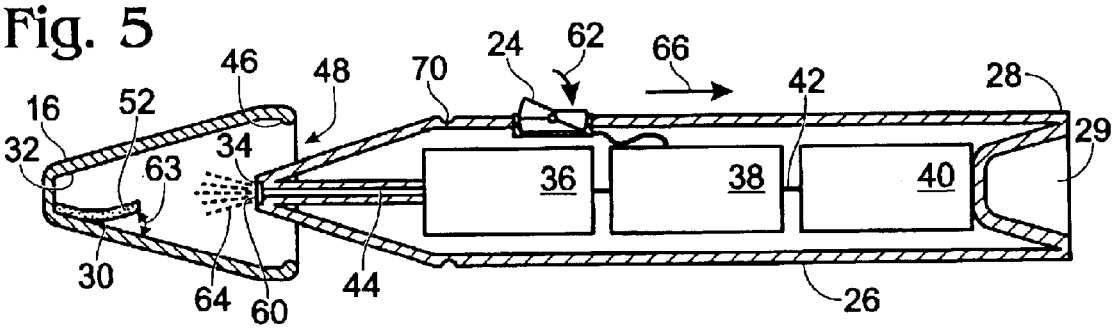
FIG. 5 is a side cross-sectional view of one form of the printing mechanism of FIG. 1, including the capping system shown completely removed from the handheld inkjet printer according to an embodiment of the present invention.

FIG. 5 is a side cross-sectional view of the printing mechanism, showing cap 16 completely removed from the handheld inkjet printer 12, such that wiper 30 is no longer in contact with printhead 34. In this position, the tip of second end region 52 of wiper 30 is nominally biased away from interior surface 32 of cap 16, such that second end region 52 of wiper 30 defines an acute angle 63, typically an angle in a range of zero to forty five degrees. In other words, upon removal of cap 16 from printer 12, wiper 30 remains biased away from interior surface 32 of the cap, such that the wiper will engage printhead 34 when cap 16 is replaced on the printer, as will be described in more detail below.

After removal of cap 16 from the printer, the cap is generally moved from its position in front of printhead 34, and switch 24 is moved in direction 62 to the ON position, so as to commence printing from the printjet device. In particular, movement of switch 24 to the ON position will close the connection between power source 40 and drive circuitry 38, such that the drive electronics 38 will instruct printhead 34 to eject fluid 64 through printhead 34 from reservoir 36. As stated above, fluid 64 may comprise a cosmetic, a medicine, an ink, or any other such fluid that may be applied by applicator 10. Due to the small size of printer 12 and printhead 34, intricate and precise application of fluid 64 may be accomplished. Morever, due to the exposed nozzle surface 60 of printhead 34, i.e., the nozzle surface 60 is not contained within the housing of a standard desktop printer, the nozzle surface 60 may be placed adjacent any print media surface. For example, nozzle surface 60 of printhead 34 may be placed against a print media surface such as human or animal skin, a wall or ceiling, a book, a package, an article of clothing, a suitcase or bag, an artist's canvas, or any other fluid receiving surface where it is desired to apply fluid 64.

Referring again to FIG. 4, to clean and cap printhead 34 after a period of use, cap 16 is moved in direction 66 to secure cap 16 to printer 12. During movement of cap 16 in direction 66, second end region 52 of wiper 30 will first engage nozzle containing surface 60 of printhead 34 adjacent wiper 30. During continued movement of cap 16 in direction 66, second end region 52 of wiper 30 will move in direction 68 across the entire nozzle containing surface 60 of printhead 34 so as to remove any excess ink and/or debris remaining on printhead nozzle surface 60.

Referring again to FIG. 3, upon full movement of cap 16 in direction 66, i.e., movement of the cap until projection 46 on interior surface 32 of the cap 16 is received within recess 70 on printer 12, second end region 52 of wiper 30 will be positioned in contact with and covering the entirety of nozzle containing surface 60 of printhead 34. Accordingly, the wiper 30 cleans debris from printhead 34 during capping of the printhead, and thereafter, the wiper will cap, i.e., seal the printhead, such that contaminates cannot enter the printhead and such that fluid remaining within the nozzle openings 34*a* of the printhead will not become dried and block or inhibit functioning of the printhead during the next period of use.

The illustrated embodiment of FIGS. 1–5 is shown to illustrate the principles and concepts of the invention as set forth in the claims below, and a variety of modifications and variations may be employed in various implementations while still falling within the scope of the claims below.

I claim:

1. A capping system for a printhead, comprising:

a handheld printjet printing device including a printhead; and a cap including a flexible wiper, said cap structured to be manually placed on said printing device so that said wiper wipes said printhead during manual placement of said cap thereon.

2. A capping system according to claim 1 wherein said wiper further seals said printhead after manual placement of said cap on said printing device.

3. A capping system according to claim 1 wherein said printhead further includes a plurality of nozzle apertures and wherein said wiper wipes and seals said nozzle apertures during manual placement of said cap thereon.

4. A capping system according to claim 1 wherein said printing device comprises a pen having a generally cylindrical shaped body, and wherein placement of said cap on said pen frictionally secures said cap to said pen.

5. A capping system according to claim 1 wherein said printing device and said cap comprises a cross sectional shape that ensures placement of said cap on said printing device in a predetermined orientation.

6. A capping system according to claim 1 wherein said printhead device includes fluid therein for ejecting from said printhead, and wherein said fluid is chosen from the group consisting of a cosmetic fluid, a medical fluid, and ink.

7. A capping system according to claim 1 wherein said printing device includes a fluid reservoir operatively connected to said printhead, a controller operatively connected to said printhead, a self-contained power source operatively connected to said controller, and a switch operatively connected to said power source.

8. A capping system according to claim 1 wherein said flexible wiper includes a first region secured to an interior surface of said cap and a second region positioned opposite said first region and structured for wiping said printhead.

9. A capping system according to claim 8 wherein said flexible wiper is secured to said cap such that said second region defines an acute angle with respect to said interior surface of said cap and such that manual placement of said cap on said printing device moves said second region of said flexible wiper away from said interior surface of said cap thereby increasing said acute angle.

10. A capping system for a printhead, comprising:

a handheld printjet printing device including a printhead; and a cap including a flexible wiper, said cap structured to be manually placed on said printing device so that said wiper wipes said printhead during manual removal of said cap from said printing device.

11. A capping system according to claim 10 wherein said wiper further uncaps said printhead during manual removal of said cap from said printing device.

12. A capping system according to claim 10 wherein said printhead further includes a plurality of nozzle apertures and wherein said wiper wipes and uncaps said nozzle apertures during manual placement of said cap thereon.

13. A capping device, comprising:

a cap adapted for manual placement on a portable handheld, printing device, said cap including a hollow interior surface; and a wiper having first and second end regions, said first end region secured to said interior surface and said second end region being biased away from said interior surface.

14. A capping device according to claim 13 wherein said wiper is manufactured of a flexible, resilient material, and in the nominal position said second end region defines an acute angle with respect to said interior surface of said cap.

15. A method of servicing the printhead of a handheld printer, comprising the steps of:

providing a handheld printer that includes a printhead;

providing a cap including a flexible wiper secured thereto;

manually moving at least one of said cap and said printer so as to frictionally secure said cap to said printer; and wiping said wiper across said printhead during said manually moving.

16. A method according to claim 15 wherein said printhead includes nozzles located on a nozzle surface, and wherein when said cap is frictionally secured to said printer, said wiper seals each nozzle on said nozzle surface.

17. A method of servicing the printhead of a handheld printer, comprising the steps of:

providing a handheld printer that includes a printhead;

providing a cap including a flexible wiper secured thereto, said cap frictionally secured to said printer;

manually removing said cap from said printer; and wiping said wiper across said printhead during said manually removing.

18. A method according to claim 17 wherein said printhead further includes nozzles located on a nozzle surface, the method further comprising:

uncapping said nozzles during the manually removing.

19. A handheld printing device, comprising:

a generally cylindrical printer body housing a printhead, a fluid reservoir, drive circuitry and a self-contained power source; and a generally cylindrical cap adapted for engagement with said printer body, said cap including a flexible wiper adapted for wiping said printhead during engagement of said cap with said printer body.

20. A handheld printing device according to claim 19 wherein said printer body includes an end region having a predetermined shape, said cap defines a mating predetermined shape, and wherein said predetermined shape ensures said cap frictionally engages said printer body in a single, predetermined orientation.

21. A handheld printing device according to claim 20 wherein said predetermined shape comprises a "D" shaped cross section.

22. A system for capping the fluid-ejecting nozzles of a printhead in a printing apparatus, comprising:

a printing apparatus including a printhead having fluid-ejecting nozzles and a generally elongate body having an outer width dimension of less than one inch and an outer length dimension of less than twelve inches; and a cap adapted for securement to an exterior surface of said elongate body so as to seal said fluid ejecting nozzles within said cap.

23. A system for capping according to claim 22 wherein said cap comprises a hollow interior surface having a flexible member secured thereto, and wherein when said cap is secured to said elongate body, said flexible member seals said fluid-ejecting nozzles of said printhead.

24. A system for capping according to claim 22 wherein said cap comprises a hollow interior surface having a flexible member secured thereto, and wherein during securement of said cap to said elongate body, said flexible member wipes said fluid-ejecting nozzles of said printhead.

25. A capping system for a printhead, comprising:

handheld printing means including a printhead; and capping means including flexible wiping means, said capping means structured to be manually placed on said printing means so that said wiping means wipes said printhead during manual placement of said capping means thereon.

26. A capping system according to claim 25 wherein said wiping means further seals said printhead after manual placement of said capping means on said printing means.

27. A capping system according to claim 25 wherein said printhead further includes a plurality of nozzle apertures and wherein said wiping means wipes and seals said nozzle apertures during manual placement of said capping means thereon.

* * * * *